US007626482B2

(12) United States Patent
Huang

(10) Patent No.: US 7,626,482 B2
(45) Date of Patent: Dec. 1, 2009

(54) SAFETY SWITCH

(76) Inventor: Albert Huang, 3F, No. 146, Sec. 4, Chungking N. Rd., Taipei (TW)

( * ) Notice: Subject to any disclaimer, the term of this patent is extended or adjusted under 35 U.S.C. 154(b) by 131 days.

(21) Appl. No.: 12/010,131

(22) Filed: Jan. 22, 2008

(65) Prior Publication Data

US 2009/0184795 A1 Jul. 23, 2009

(51) Int. Cl.
*H01H 71/16* (2006.01)
*H01H 71/58* (2006.01)

(52) U.S. Cl. ..... 337/59; 337/62; 337/66; 337/72

(58) Field of Classification Search ..... 337/62, 337/59, 66, 72; 200/553, 339, 341
See application file for complete search history.

(56) References Cited

U.S. PATENT DOCUMENTS 3,106,621 A * 10/1963 Bruno ..... 200/461
4,258,349 A * 3/1981 Flory ..... 337/46
5,491,460 A * 2/1996 Krasser et al. ..... 337/70
5,539,371 A * 7/1996 Yu ..... 337/66
5,828,284 A * 10/1998 Huang ..... 337/37
5,982,269 A * 11/1999 Sorenson ..... 337/380
6,072,381 A * 6/2000 Yu ..... 337/37
6,094,126 A * 7/2000 Sorenson ..... 337/37
6,252,490 B1 * 6/2001 Lin ..... 337/79
6,275,133 B1 * 8/2001 Chen ..... 337/37
6,275,134 B1 * 8/2001 Chen ..... 337/37
6,307,459 B1 * 10/2001 Yu ..... 337/37
6,400,250 B1 * 6/2002 Wang ..... 337/66
6,452,125 B1 * 9/2002 Yu ..... 200/553
6,469,610 B1 * 10/2002 Chen ..... 337/66
6,483,416 B2 * 11/2002 Yu ..... 337/126
6,525,639 B1 * 2/2003 Cheng ..... 337/37
6,538,553 B2 * 3/2003 Yu ..... 337/365
6,864,453 B1 * 3/2005 Yu ..... 200/520
6,884,955 B1 * 4/2005 Yu ..... 200/553
6,940,389 B1 * 9/2005 Yu ..... 337/66
7,005,957 B2 * 2/2006 Yu ..... 337/66
7,026,906 B2 * 4/2006 Huang ..... 337/59
7,283,031 B2 * 10/2007 Huang ..... 337/66
7,292,129 B2 * 11/2007 Yu ..... 337/66
7,307,506 B2 * 12/2007 Yu ..... 337/94
2003/0011461 A1 * 1/2003 Yu ..... 337/89
2003/0071710 A1 * 4/2003 Yu ..... 337/66

(Continued)

FOREIGN PATENT DOCUMENTS

CH 647094 A * 12/1984

*Primary Examiner*—Anatoly Vortman
(74) *Attorney, Agent, or Firm*—Bacon & Thomas, PLLC

(57) ABSTRACT

A safety switch has a housing, a conducting assembly, a switching assembly and a resilient member. The housing has an on-end and an off-end. The conducting assembly is mounted in the housing and has two conductors and a bimetal strip. The conductors respectively correspond to the on and off-ends and are attached respectively to two separated ends of a circuit. The bimetal strip selectively connects the conductors. The switching assembly has a rocker and a connecting arm. The rocker is mounted pivotally on a top of the housing. The connecting arm connects the rocker and a contacting end of the bimetal strip. The resilient member is mounted between the on-end of the housing and the rocker to stably position the rocker when the circuit is on or off.

4 Claims, 3 Drawing Sheets

U.S. PATENT DOCUMENTS

2003/0137390 A1* 7/2003 Huang ..... 337/37
2005/0264392 A1* 12/2005 Yu ..... 337/66
2007/0001798 A1* 1/2007 Yu ..... 337/66

* cited by examiner

SAFETY SWITCH

BACKGROUND OF THE INVENTION

1. Field of the Invention

The present invention relates to a safety switch, which interrupt a circuit over current.

2. Description of the Prior Arts

A conventional safety switch is applied to protect an electrical product from being damaged by a voltage strike that may cause the electronic elements on the circuit being burned.

The conventional switch has two conductive legs and a bimetal strip. The conductive legs are connected respectively to two ends of the circuit and separate from each other. The bimetal strip is attached to and is pressed by the switch to connect the conductive legs as a current conductor, is made of two metal sheets having different thermal expansion coefficients and selectively bends against pressing of the switch to disconnect the conductive legs so as to cut off the circuit when heated by the sudden over current.

Additionally, bending of the bimetal strip is relative to movement of the switch between turn-on and turn-off. If the switch is too loose to be turned between on and off, the bimetal strip might be bent easily when being heated and cause the circuit being cut off frequently. Moreover, the bent heated bimetal strip might recover to be straight easily and turn on the switch unexpectedly after the temperature lowers, such that might lead to burning of the circuit.

To overcome the shortcomings, the present invention provides a safety switch to mitigate or obviate the aforementioned problems.

SUMMARY OF THE INVENTION

The primary objective of the present invention is to provide a safety switch that prevents a circuit from being switched between on and off states unexpectedly.

The safety switch has a housing, a conducting assembly, a switching assembly and a resilient member. The housing has an on-end and an off-end. The conducting assembly is mounted in the housing and has two conductors and a bimetal strip. The conductors respectively correspond to the on and off-ends and are correspondingly attached to two separated ends of the circuit. The bimetal strip selectively connects the conductors. The switching assembly has a rocker and a connecting arm. The rocker is mounted pivotally on a top of the housing. The connecting arm connects the rocker and a contacting end of the bimetal strip. The resilient member is mounted between the on-end of the housing and the rocker to stably position the rocker when the circuit is on or off.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
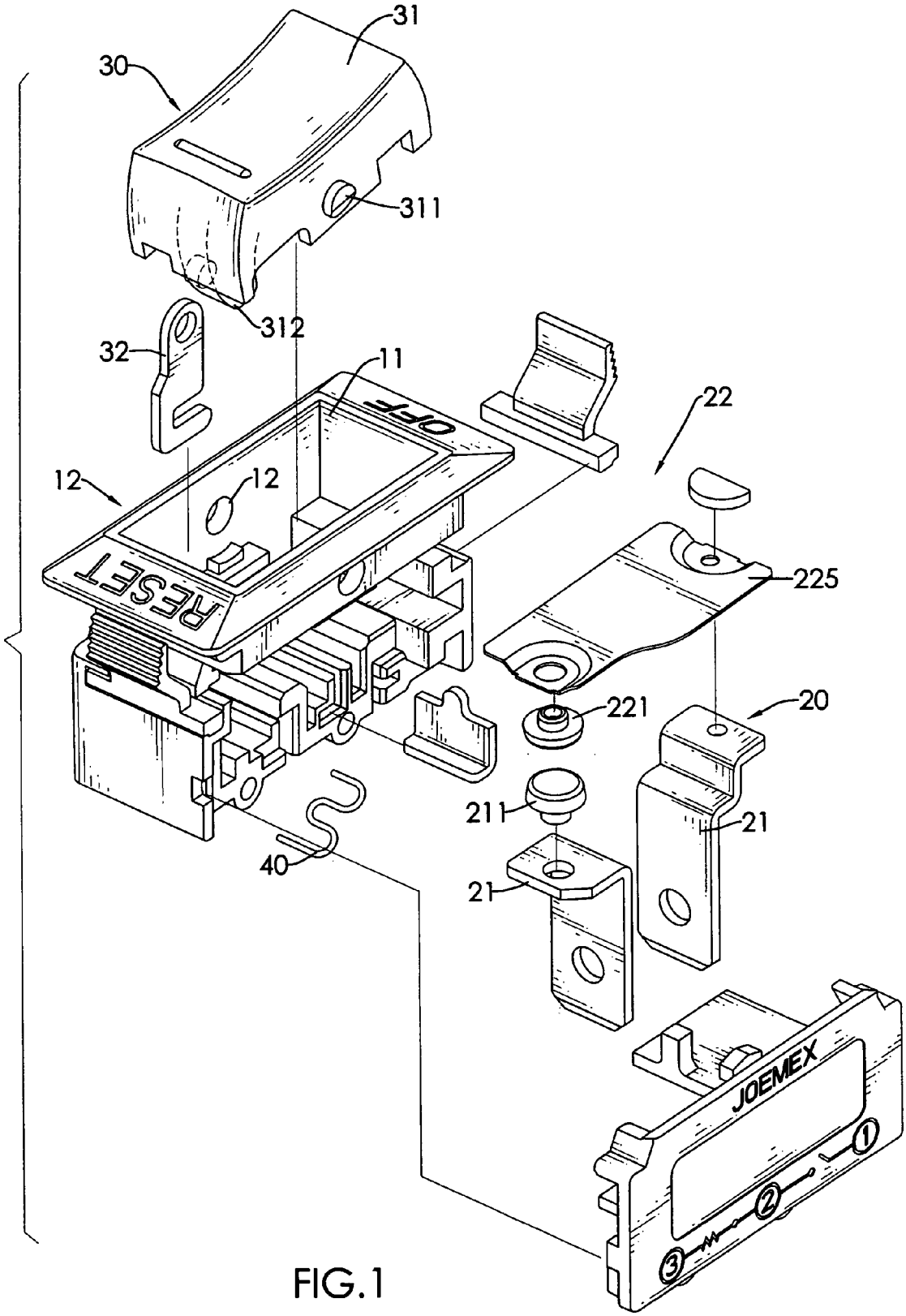
FIG. 1 is an exploded perspective view of a safety switch in accordance with the present invention.
Figure 2:
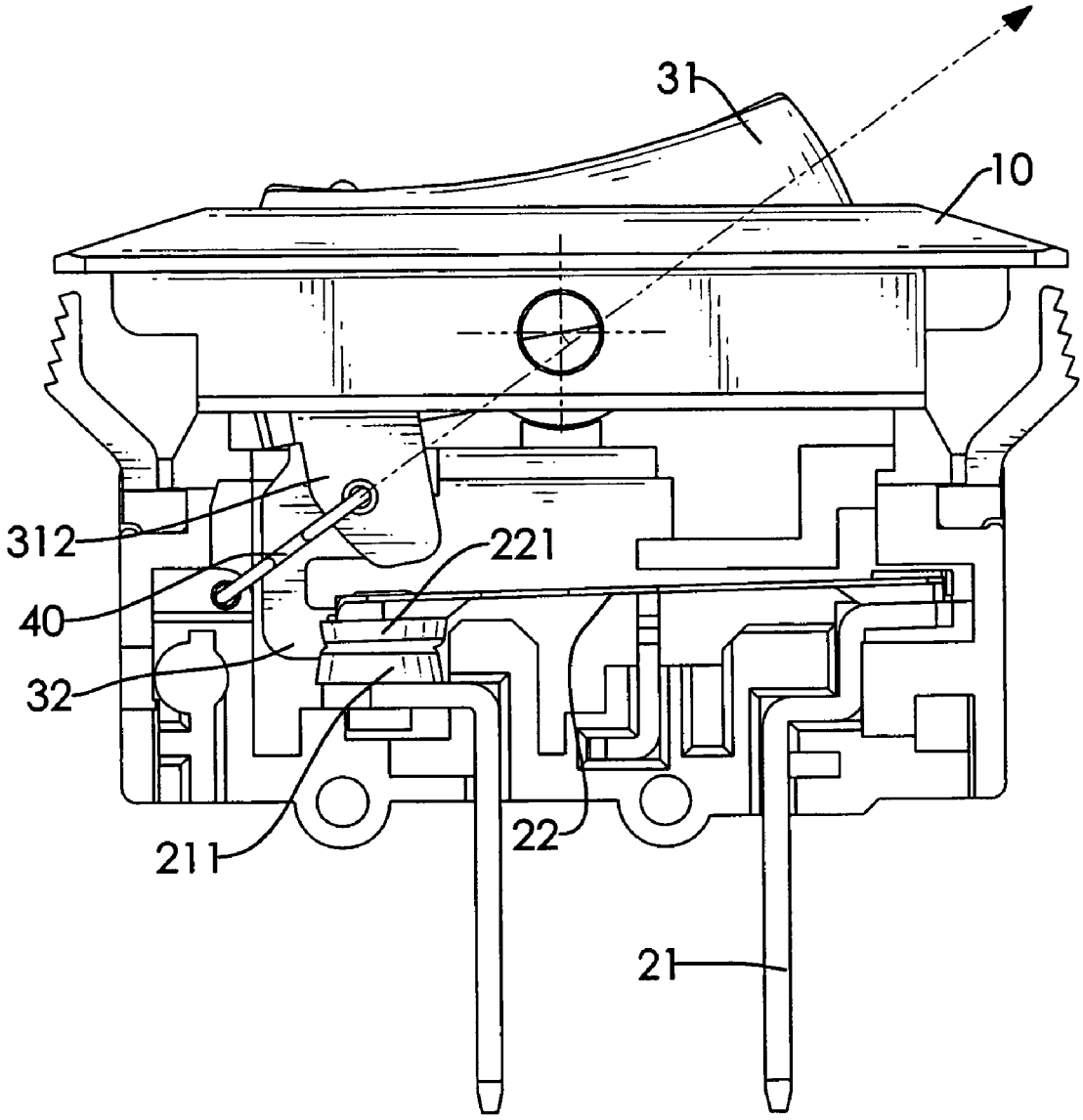
FIG. 2 is an operational side view of the safety switch in FIG. 1.

With reference to FIGS. 1 and 2, a safety switch in accordance with the present invention comprises a housing (10), a conducting assembly (20), a switching assembly (30) and a resilient member (40).

The housing (10) is hollow and has a top, a bottom, an on-end, an off-end, two side surfaces, an opening (11) and two optional pivot holes.

The opening (11) is formed through the top of the housing (10).

The pivot holes (12) are formed respectively through the side surfaces of the housing (10).

The conducting assembly (20) has two conductors (21) and a bimetal strip (22).

The conductors (21) are mounted through the bottom of the housing (10) respectively near the on-end and the off-end and protrude out of the bottom of the housing (10) to attach respectively to two separated ends of a circuit. Each conductor (21) has an inner end and the conductor (21) near the on-end of the housing (10) may have a conducting head (211).

The conducting head (211) is mounted securely on the inner end of the conductor (21) near the on-end of the housing (10).

The bimetal strip (22) is made of two metal sheets with different thermal expansion coefficients and has a stationary end, a contacting end and an optional conducting head (221).

The stationary end is mounted securely on the inner end of the conductor (21) near the off-end of the housing (10).

The contacting end selectively contacts the inner end of the conductor (21) near the on-end of the housing (10) to connect the separated ends of the circuit. The contacting end bends upwards to separate from the inner end of the conductor (21) when a sudden over current passes through and raises temperature of the bimetal strip (22).

The conducting head (221) is mounted securely on the contacting end of the bimetal strip (22), corresponds to and selectively contacts the conducting head (211) of the conductor (21) near the on-end of the housing (10).

The switching assembly (30) has a rocker (31) and a connecting arm (32).

The rocker (31) is mounted pivotally in the opening (11) of the housing (10) and has two sides, an activating end, a deactivating end, a bottom, two optional pivoting protrusions (311) and a spring mount (312).

The activating and deactivating ends of the rocker (31) correspond respectively to the on-end and off-end of the housing (10) and are alternatively pressed into the housing (10) to selectively switch the circuit to an on or off state.

The pivoting protrusions (311) are formed on and protrude respectively from the sides of the rocker (31) and are pivotally mounted respectively in the pivot holes (12) of the housing (10).

The spring mount (312) is formed on and protrudes downwards from the bottom of the rocker (31) at the activating end.

The connecting arm (32) is mounted pivotally and protrudes from the bottom of the rocker (31) at the activating end and is connected to the contacting end of the bimetal strip (22) to selectively bend the bimetal strip (22). Therefore, users can switch the circuit to the on or off state by pressing the rocker (31).

Figure 3:
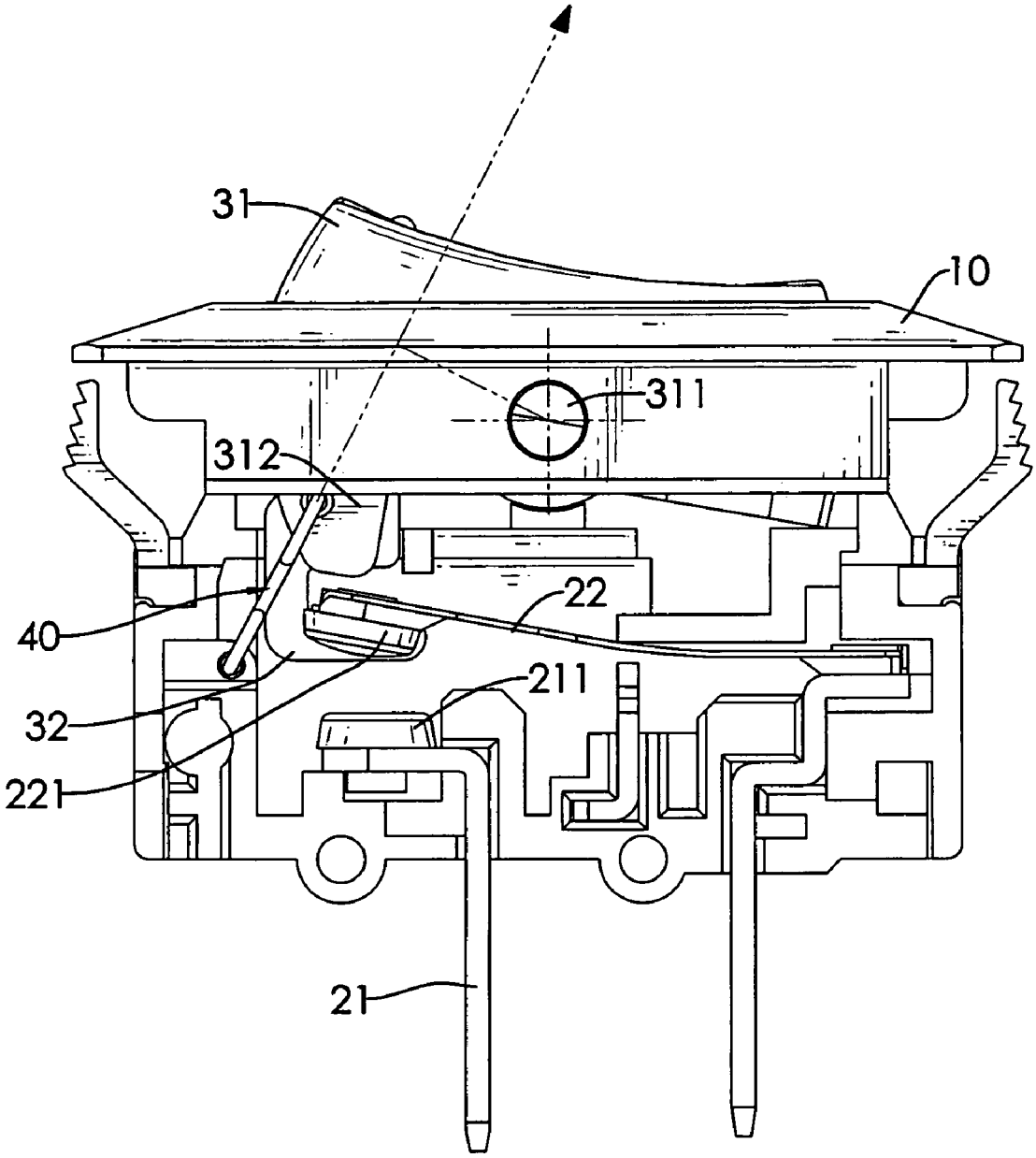
FIG. 3 is an operational side view of the safety switch in FIG. 2.

The resilient member (40) may be a spring, is mounted between the on-end of the housing (10) and the spring mount (312), presses against the rocker (31) and selectively holds the activating or deactivating end of the rocker (30) pressed when no external force pushes the rocker (30) and no over current passes through and heats the bimetal strip (22). The resilient member (40) points toward a right section between a pivoting center of the rocker (31) and the off-end of the housing (10) when the activating end of the rocker (31) is pressed into the housing (10) to provide a counterclockwise torque against bending of the bimetal strip (22) as shown in FIG. 2. Alternatively, the resilient member (40) points toward a left section between the pivoting center of the rocker (31) and the on-end of the housing (10) when the deactivating end of the rocker (31) is pressed into the housing (10) to provide a clockwise torque helping bending of the bimetal strip (22), as shown in FIG. 3.

The resilient member (40) always stably positions the rocker (31) when the circuit is on by pushing the activating end of the rocker (31) or off by pushing the deactivating end of the rocker (31). Therefore, the safety switch with the resilient member (40) effectively interrupts the circuit timely and efficiently prevents the circuit from being turned on unexpectedly due to recovery of the bimetal strip (22).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety switch comprising a housing being hollow and having a top;

a bottom;

an on-end;

an off-end;

two side surfaces; and an opening being formed through the top of the housing;

a conducting assembly having two conductors being mounted through the bottom of the housing respectively near the on- and the off-ends, protruding out of the bottom of the housing and each conductor having an inner end; and a bimetal strip being made of two metal sheets with different thermal expansion coefficients and having a stationary end being mounted securely on the inner end of the conductor near the off-end of the housing; and a contacting end being detachably attached to the inner end of the conductor near the on-end of the housing and selectively bending upwards;

a switching assembly having a rocker being mounted pivotally in the opening of the housing and having two sides;

an activating end and deactivating end, the activating and deactivating ends respectively corresponding to the on- and off-ends of the housing and being alternatively pressed into the housing;

a bottom; and a spring mount being formed on and protruding downwards from the bottom of the rocker at the end corresponding to the on-end of the housing; and a connecting arm being mounted pivotally and protruding from the bottom of the rocker at the activating end and being connected to the contacting end of the bimetal strip; and a resilient member being mounted between the on-end of the housing and the spring mount, pressing against the rocker, selectively holding the activating or deactivating end of the rocker pressed.

2. The safety switch as claimed in claim 1, wherein the resilient member is a spring.

3. The safety switch as claimed in claim 2, wherein the conductor near the on-end of the housing has a conducting head being mounted securely on the inner end of the conductor near the on-end of the housing; and the bimetal strip has a conducting head being mounted securely on the contacting end of the bimetal strip, corresponding to and selectively contacting the conducting head of the conductor near the on-end of the housing.

4. The safety switch as claimed in claim 3, wherein the housing further has two pivot holes being formed respectively through the side surfaces of the housing; and the rocker further has two pivoting protrusions being formed on and protruding respectively from the sides of the rocker and being pivotally mounted respectively in the pivot holes of the housing.

* * * * *